US005281446A

United States Patent [19]

Matheson et al.

[11] Patent Number: 5,281,446

[45] Date of Patent: Jan. 25, 1994

[54] METHODS FOR COATING PAPER BOARD CONTAINERS

[75] Inventors: Derek S. Matheson, Washington, D.C.; Wesley R. Bush, Columbia, Md.; Carlton L. Kemmet, Sykesville, Md.; Donald C. Lundgren, Columbia, Md.; David W. Norwood, Joppatowne, Md.; Robert Brown, Glen Burnie; Romano Balordi, Millers, Md.; Onisim Kransnokutsky, Baltimore, Md.

[73] Assignee: Sweetheart Cup Company Inc., Owings Mills, Md.

[21] Appl. No.: 741,757

[22] Filed: Aug. 7, 1991

Related U.S. Application Data

[62] Division of Ser. No. 550,821, Jul. 11, 1990, Pat. No. 5,078,313.

[51] Int. Cl.[5] ..... B05D 7/22; B05D 1/02

[52] U.S. Cl. ..... 427/471; 427/233; 427/416; 427/422; 427/425

[58] Field of Search ..... 427/421, 425, 424, 416, 427/402, 233, 236, 471, 476, 481, 422; 108/318, DIG. 3; 198/378, 377

[56] References Cited

U.S. PATENT DOCUMENTS

| | | | |
|---|---|---|---|
| 1,175,406 | 3/1916 | Bohlman . | |
| 1,197,324 | 9/1916 | Wright . | |
| 1,334,017 | 3/1920 | Cooley . | |
| 1,602,836 | 10/1926 | Reifsnyder . | |
| 1,869,630 | 8/1932 | Stone . | |
| 2,084,094 | 6/1937 | Kronquest et al. . | |
| 2,339,008 | 1/1944 | Gladfelter et al. . | |
| 2,698,814 | 1/1955 | Ransburg | 117/62 |
| 2,724,661 | 11/1955 | Juvinall | 117/93 |
| 3,028,798 | 4/1962 | Allen . | |
| 3,105,776 | 10/1963 | Weyhmueller | 118/DIG. 3 |
| 3,322,045 | 5/1967 | Tanona . | |
| 3,450,327 | 6/1969 | Ludder | 117/95 |
| 3,603,218 | 9/1971 | Ludder | 93/36 |
| 3,797,456 | 3/1974 | Hogstrom . | |
| 3,872,040 | 3/1975 | Mollohan et al. | 260/21 |
| 4,168,676 | 9/1979 | Itoh | 118/622 |
| 4,186,225 | 1/1980 | Smith et al. . | |
| 4,211,339 | 7/1980 | Itoh | 220/450 |
| 4,246,300 | 1/1981 | Jensen | 118/318 X |
| 4,283,189 | 8/1981 | Itoh | 493/109 |
| 4,318,703 | 3/1982 | Richards et al. | 493/149 |
| 4,511,025 | 4/1985 | Nakayama | 198/377 |
| 4,640,406 | 2/1987 | Willison | 198/377 |
| 5,078,313 | 1/1992 | Matheson et al. | 229/1.5 |

FOREIGN PATENT DOCUMENTS

| | | |
|---|---|---|
| 0063996 | 11/1982 | European Pat. Off. . |
| 232592 | 7/1909 | Fed. Rep. of Germany . |
| 873494 | 7/1942 | France . |
| 1073619 | 9/1954 | France . |
| 142867 | 5/1921 | United Kingdom . |
| 341908 | 1/1931 | United Kingdom . |

*Primary Examiner*—Marianne Padgett

*Attorney, Agent, or Firm*—Nixon & Vanderhye

[57] ABSTRACT

Single ply paperboard containers are wax-coated by directing a relatively narrow spray band of atomized wax towards the interior surfaces of the containers being treated. The spray band is volumetrically asymmetrical and is oriented relative to the interior surfaces of the container such that its volumetric asymmetry is directed towards the bottom circumferential seam between the tubular side wall and bottom wall of the containers. In this manner, a minimal (but fluid-impervious effective) nonsaturating amount of wax will be applied to the interior surfaces of the container so as to preserve the vivid appearance of color graphics and/or indicia that may be printed on the exterior surface of the container. At the same time, the volumetric asymmetry and orientation of the spray band ensures that a maximum amount of wax will be applied at or near the circumferential bottom seam so that a fluid-impervious fillet seal may be established thereat. The appearance of the color graphics and/or indicia may optionally be further improved by the electrostatic spray application of a suitable lacquer. The applied lacquer, when dried, will thereby enhance the "glossy" exterior appearance of the interior wax-coated containers.

16 Claims, 10 Drawing Sheets

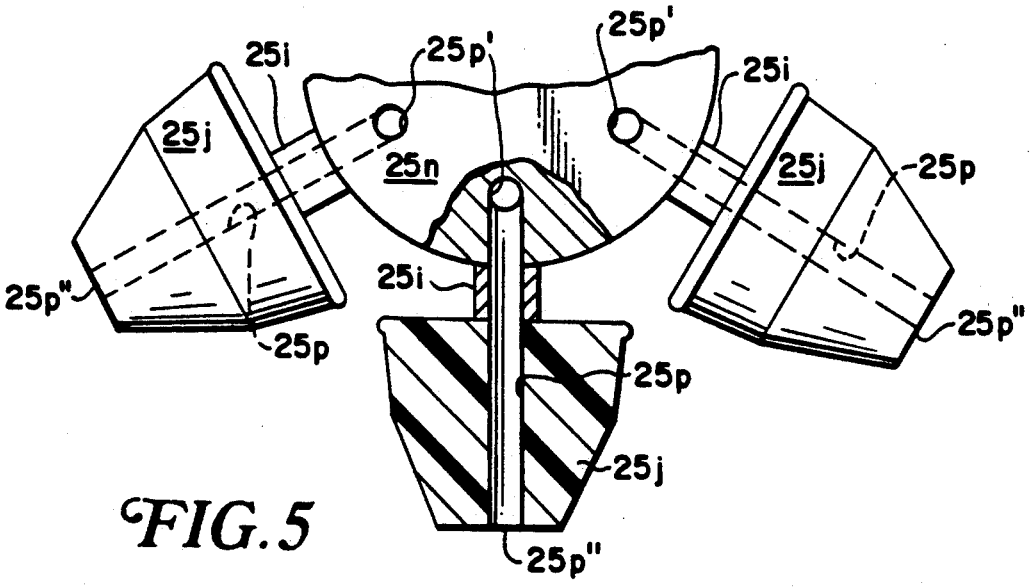
FIG. 5
FIG. 6
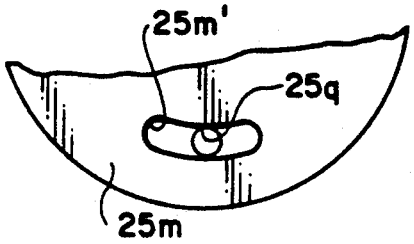

METHODS FOR COATING PAPER BOARD CONTAINERS

This is a division of application Ser. No. 07/550,821, filed Jul. 11, 1990 (now U.S. Pat. No. 5,078,313).

FIELD OF INVENTION

The present invention generally relates to paperboard containers, for example, paper cups and the like. More specifically, the present invention relates to single ply paperboard containers having a coating of a fluid-impervious material (e.g., wax).

BACKGROUND OF THE INVENTION

Containers made of single ply paperboard stock have for many years been heavily coated with a wax or wax-like material so as to render the paperboard fluid-impervious, and thereby more suitable for containing foodstuffs (particularly liquids). In this regard, it has been the conventional practice to apply an excess volume of wax to the interior and/or exterior walls of the single ply paperboard container, and to thereafter drain or otherwise remove the unneeded wax from the cup. According to this conventional wax-coating technique, therefore, the applied wax saturates the entire thickness of the paperboard walls to render the container fluid-impervious. Specific examples in the art whereby single ply paperboard containers are saturated with wax include U.S. Pat. Nos. 1,175,406 and 1,197,324.

One problem associated with heavily waxed paperboard containers is that the wax is visibly perceptible on the exterior surface—i.e., since the wax saturates the entire thickness of the paperboard and transforms the normally opaque paperboard stock to an essentially translucent visual appearance. This transformation of the normal opacity of paperboard containers to translucency due to the effect of the saturated wax in turn "dulls" the otherwise vivid color graphics and/or indicia that may be printed upon the exterior surface of the paperboard container. The relatively dulled container appearance (as compared to non-wax-coated containers having the same color graphics and/or indicia) that results is less than aesthetically desirable.

One solution that has been practiced extensively in the art is to make multi-ply paperboard containers (i.e., having inner and outer paperboard plies) with a wax-barrier layer therebetween as represented by U.S. Pat. Nos. 3,450,327 and 3,603,218. When wax is applied to the inner paperboard ply according to this prior art technique, the wax-barrier layer (which is typically a layer of adhesive material that laminates the inner and outer paperboard plies one to the other) prevents the wax from penetrating to the outer paperboard ply. As a result, the outer paperboard ply retains its normal opacity, such that color graphics and/or indicia on its exterior surface of are not dulled by the presence of wax that would have otherwise occurred had the container been fabricated from single ply paperboard stock.

Recently, significantly more "glossy" polymer-coated containers having improved appearances over heavily wax coated paperboard containers have been proposed. These relatively more "glossy" containers usually are constructed of an interior layer of paperboard that is laminated on its interior and/or exterior surfaces with a suitable thermoplastic polymeric material, for example, polyethylene. In this regard, U.S. Pat. Nos. 4,168,676, 4,211,339 and 4,283,189 generally disclose paperboard containers which are electrostatically spray-coated with a thermoplastic polymer powder. The spray-coated powder on the cup surface is then subjected to heat treatment, whereby the polymeric powder melts and forms a laminated polymeric coating on the paperboard layer.

Except for appearance characteristics, wax-coated containers are preferred for a number of reasons, including lower raw material costs and/or relative ease of container recyclability, to name just a few. What has been needed in the art, therefore, are improved wax-coating methods and apparatus whereby wax-coated single ply paperboard containers are made to exhibit an aesthetically desirable "glossy" exterior surface. In such a manner, the "glossy" wax-coated containers would exhibit appearance characteristics comparable to polymer-coated paperboard containers, while yet preserving the other beneficial attributes associated with conventional wax-coated containers. It is towards providing such methods and apparatus that the present invention is directed.

SUMMARY OF THE INVENTION

The present invention is embodied in novel methods and apparatus for wax-coating interior surfaces of single ply paperboard containers. The equally novel interior wax-coated single ply paperboard containers of the present invention will thereby exhibit improved exterior "gloss" characteristics as compared to conventional heavily wax-coated single ply containers of the prior art. At the same time, the containers of the present invention exhibit desirable fluid-impervious characteristics that are at least comparable to conventional heavily wax- and polymer-coated containers.

The present invention more specifically involves the controlled volumetric metering of wax onto the interior surface of the paperboard container so as to, in turn, control the wax build-up on that interior surface. In this regard, molten wax is preferably atomized in the form of a narrow longitudinal (relative to the container) spray band that is directed at a corresponding narrow region of the interior container surface. The upper extent of this spray band is directed so as to be generally tangential to the upper lip of the container (usually called the "top curl" in art parlance), whereas the lower extent of the spray band is directed so as generally to be coincident with the centerline of the container at the container's bottom wall.

The volumetric distribution of wax per unit time within the spray band as described above is, moreover, asymmetrically biased towards the container's bottom wall. That is, there is a greater amount of wax per unit time directed generally towards the bottom seam between the container's bottom wall and its tubular side wall, as compared to the volumes of wax directed towards the interior surface portions of the container adjacent the bottom seam. This asymmetric biasing of wax distribution within the relatively narrow spray band serves to apply a minimum (but fluid-impervious effective) amount of wax onto a major extent of the interior surfaces associated with both the side and bottom walls. At the same time, the volumetric asymmetry of the spray band serves to apply a maximum amount of wax on and/or near the bottom seam so that an adequate fluid seal of wax may be formed thereat.

The controlled volumetric application of wax onto the interior surfaces of the container is such that the applied wax does not saturate the single ply paperboard walls of the container. Instead, successive layers of wax are applied one on top of the other by effecting relative rotation between the container and the spray band. The normally opaque visual appearance of the paperboard is thus preserved (i.e., the paperboard is not rendered translucent by virtue of the paperboard being saturated with wax). As a result, the applied wax is not visibly perceptible on the exterior surface of the containers according to the present invention, and therefore does not "dull" color graphics and/or indicia printed on the container's exterior surface.

According to a further aspect of the present invention, the appearance of the color graphics and/or indicia on the exterior surface of the container may be further improved by coating the container's exterior surface with a liquid lacquer material. The lacquer may be electrostatically sprayed onto the container's exterior surface prior or subsequent to the interior wax coating, or may be pre-applied onto the graphic-printed paperboard stock prior to container formation. Whatever the application technique, the lacquer, when dried, will thereby enhance the "glossy" appearance of the color graphics and/or indicia printed on the container's exterior surface, giving it a look comparable to polymer-coated containers. In addition, the exterior lacquer coating provides a moisture barrier which is important if the containers of this invention are embodied in cold drink cups.

These aspects, as well as others, will become more clear after careful consideration is given to the following detailed description of the preferred exemplary embodiments.

BRIEF DESCRIPTION OF THE ACCOMPANYING DRAWINGS

Reference will hereinafter be made to the accompanying drawings wherein like reference numerals throughout the various FIGURES denote like structural elements, and wherein;

FIG. 5 is a partial elevational view of the cup-inversion mechanism as taken along line 5—5 in FIG. 4;

FIG. 6 is a partial elevational view of the stationary air-distributor plate associated with the cup-eversion mechanism as taken along line 6—6 in FIG. 4;

FIG. 12 is photograph taken at 5X magnification showing a cross-section of a paperboard sidewall of a prior art heavily wax-coated cup;

FIG. 13 is a photograph taken at 5X magnification showing a cross-section of a paperboard sidewall of an interiorly wax-coated cup according to the present invention; and FIG. 14 is a schematic perspective view of another embodiment of the wax-coating apparatus according to the present invention.

DETAILED DESCRIPTION OF THE PREFERRED EXEMPLARY EMBODIMENTS

Figure 1:
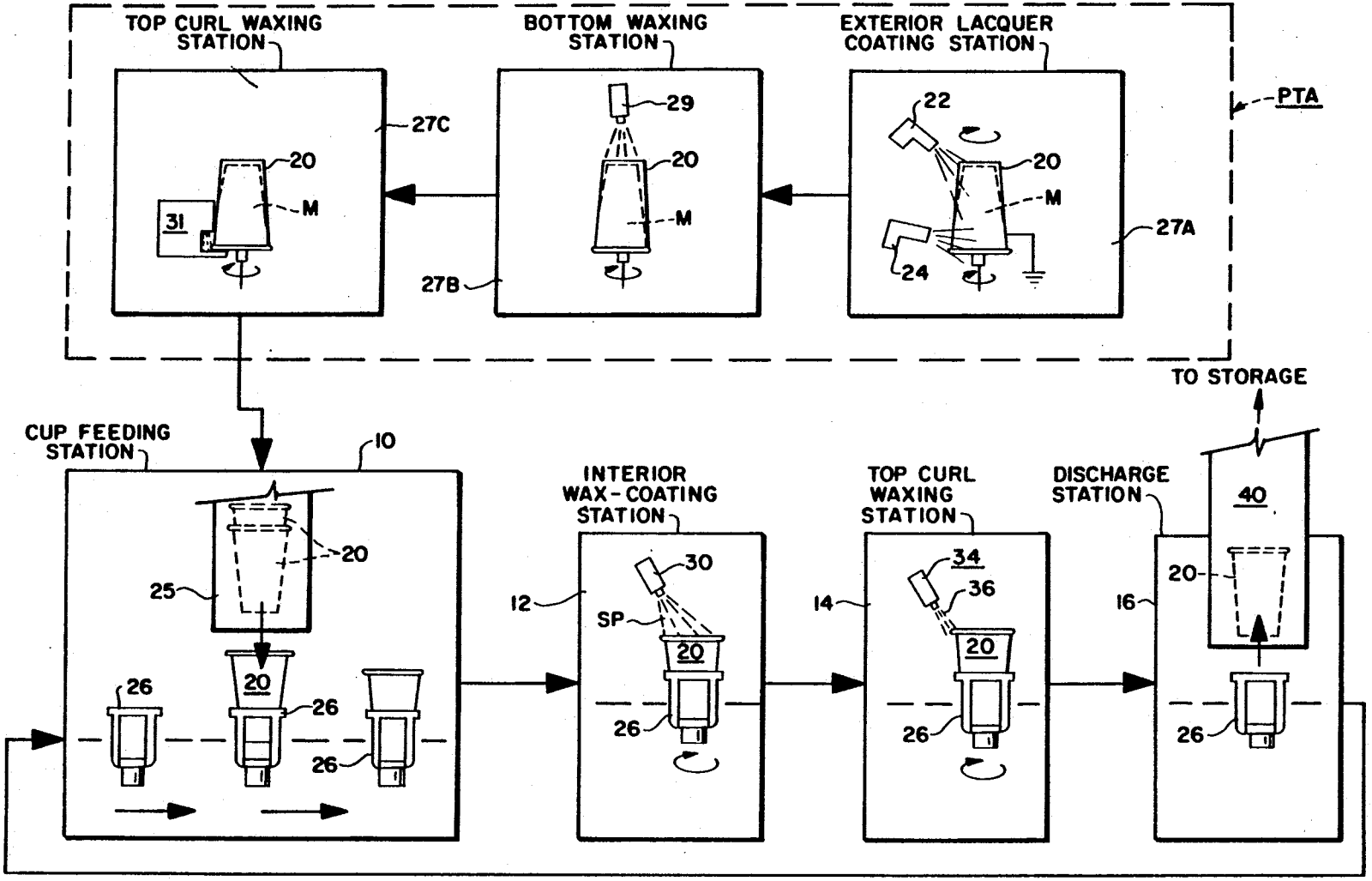
FIG. 1 is a schematic diagram showing the principal stations involved in the methods and apparatus of the present invention.

The principal aspects according to the present invention are diagrammatically represented in accompanying FIG. 1. As is shown, the methods and apparatus of the present invention are generally comprised of a container feeding station 10, an interior wax-coating station 12, a top curl application station 14, and a discharge station 16. Optionally, a pretreatment assembly PTA may be provided so as to accomplish a number of beneficial functions prior to interior wax-coating of the containers 20.

It should be noted here that the containers 20 may sometimes be referred to hereinafter as "cups" or the like. However, the reader will appreciate that such a reference is nonlimiting to the present invention since a variety of paperboard containers having a variety of purposes may satisfactorily be wax-coated using the techniques to be discussed below.

The preferred containers that especially benefit from the wax-coating techniques of the present invention are those having a planar bottom wall and a generally tubular side wall joined to the bottom wall along a circumferential seam as is well known in this art. Typically, the tubular side wall will be slightly tapered so that its diameter at the upper open end is greater as compared to the diameter at the bottom wall. In addition, the containers will typically have an integral outwardly curled portion circumferentially extending along the side wall's upper edge and thereby forming an upper lip of the container. This so-called "top-curl" is especially desirable if the container is in the form of a drinking cup as it increases the rigidity of the cup along the circumferential upper edge of the side wall.

Turning attention again to accompanying FIG. 1, the container feeding station 10 is depicted as including a feeding mechanism 25 that sequentially feeds containers 20 to be interiorly wax coated in synchronous relationship to the conveyance of container holders 26 moving along a path. Empty ones of the container holders 26 are thereby conveyed into position relative to the feeding mechanism 25, whereby a container 20 is synchronously deposited by the feeding mechanism 25 thereinto. The containers 20 are then conveyed along with the container holders 26 to the downstream interior wax coating station 12.

The interior wax coating station 12 serves to coat the interior surfaces of the container 20 and thereby render it fluid-impervious. In this regard, a spray nozzle 30 is brought into indexed relationship with the open end of the container 20 so that a specially configured spray pattern SP of atomized molten wax can be directed against the interior surfaces of the container 20. As will be described in significantly greater detail below, the spray pattern SP is such that the amount of wax that is applied to the container interior surfaces by means of the spray nozzle 30 is insufficient to saturate the single ply paperboard stock from which the container 20 is made. The container holders 26, and thus the containers 20 held thereby, are rotated relative to the spray pattern SP so that the molten wax is applied to the interior container surface in a plurality of successive layers.

The interiorly wax-coated container 20 may then be conveyed in its holder 26 to a top curl waxing station 14. When the container 20 is positioned at the top curl waxing station 14, a secondary nozzle 34 directs a stream 36 of atomized molten wax along a localized circumferential region that corresponds to the top curl of the container 20. In this manner, the circumferential rigidity of the container's side wall along its upper edge can be further increased by a localized "loading" of the top curl with a relatively volumetrically heavy amount of wax. Again, the container holder 26 is preferably rotated relative to the stream 36 of molten wax emitted by the secondary nozzle 34 to ensure that the entire circumference of the container top curl is wax-coated.

The container holders may then be conveyed to a downstream discharge station 16 where the interiorly wax-coated containers 20 are sequentially withdrawn from their respective holders 26 and conveyed to an off-site storage location, for example. The discharge station 16 preferably includes a pneumatic discharge/-conveyance system 40 that serves to pneumatically withdraw the containers 20 from their respective holders 26 and then convey the removed containers 20 to an off-site location. The now empty holders 26 may subsequently be returned on a continual basis to the cup feeding station 12 where a "fresh" cup (i.e., not having a wax coating on its interior surfaces) may be deposited thereinto via the cup feeding mechanism 25.

As briefly indicated above, the cups 20 may be subjected to a variety of optional pretreatments which are identified collectively in FIG. 1 as a pretreatment assembly PTA. For example, the pretreatment assembly PTA may include an exterior lacquer coating station 27A where the exterior surface of the containers 20 may be coated with a high gloss lacquer using electrostatic spray coating guns 22, 24. In this regard, the cup 20 will preferably be conveyed relative to the coating guns 22, 24 in an inverted manner via an electrically conductive and grounded cup mandrel M. The guns 22, 24 are connected to a source of electrical power so as to charge the atomized particles of liquid lacquer discharged therefrom. These charged lacquer particles are thus attracted towards the grounded mandrel M. As a result, the exterior surface of the cups 20 is coated with minimal overspray using a minimal amount of lacquer.

When dried (which drying may be facilitated in a heated environment), the exterior lacquer-coated container 20 may then be conveyed to a bottom waxing station 27B where a localized spray of molten wax is applied onto the exterior surface of the cup's bottom wall. This localized application of wax onto the cup's bottom wall increases the sealing effect at the bottom of the cup, in addition to improving the moisture barrier properties of the cup bottom, and/or enhancing the cup's stiffness at the bottom wall. Relatively heavy application of wax on the exterior surface of the cup's bottom wall will not deleteriously affect the aesthetic appearance of the cup since, even though heavily applied, it will not saturate the thickness of the paperboard stock. As a result, the opacity of the bottom wall will not be transformed to a more translucent appearance. In addition, the bottom wall will remain essentially out of sight when the cup is displayed or used.

The cup 20 may also be conveyed to a top curl waxing station 27C where a localized and relatively heavy application of wax to the top curl of cup 20 can be achieved. In this regard, it will be appreciated that if the pretreatment assembly PTA includes the top curl waxing station 27C, then the downstream top curl waxing station 14 described previously does not necessarily need to be employed. In top curl waxing station 27C, however, the cup 20 is rotatably conveyed into operative association with a wax applicator 31. The wax applicator 31 may be embodied in a variety of structures which serve to apply a localized heavy region of wax circumferentially along the cup's top curl. For example, wax applicator 31 may be in the form of structure that establishes a continual flowing layer of molten wax through which the top curl of the inverted cup 20 is rotated. As a result, a locally heavily waxed top curl for cup 20 is achieved thereby increasing the cup's stiffness thereat.

The pretreated cup 20 may then be inverted and synchronously discharged from the pretreatment assembly PTA and deposited into an empty one of the holders 26 being conveyed in the cup feeding station 10. Thus, in the event that the pretreatment assembly PTA is employed, the cup feeding mechanism 25 as described previously will not be physically located as shown in FIG. 1, but instead will be located upstream of the pretreatment assembly PTA.

Figure 2:
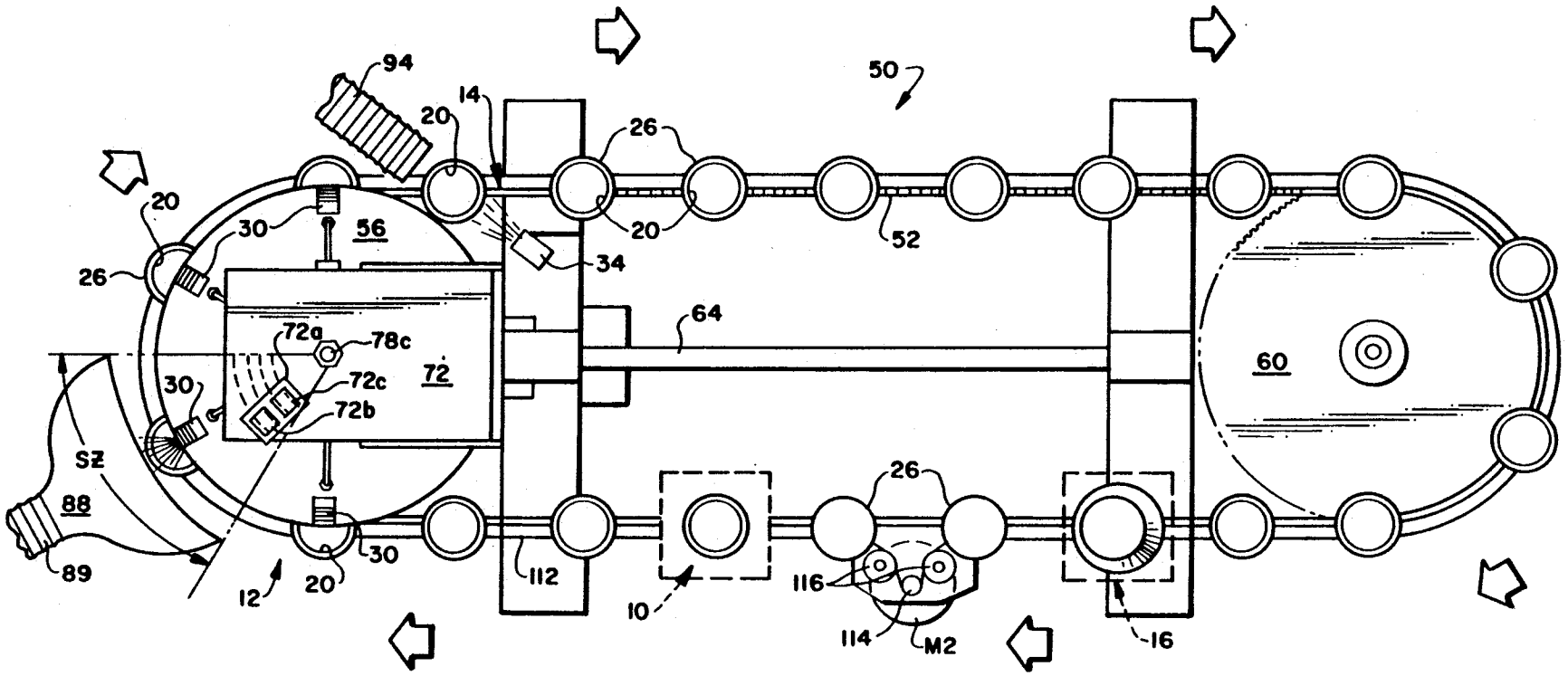
FIG. 2 is a top plan view of one embodiment of an apparatus according to the present invention.
Figure 3:
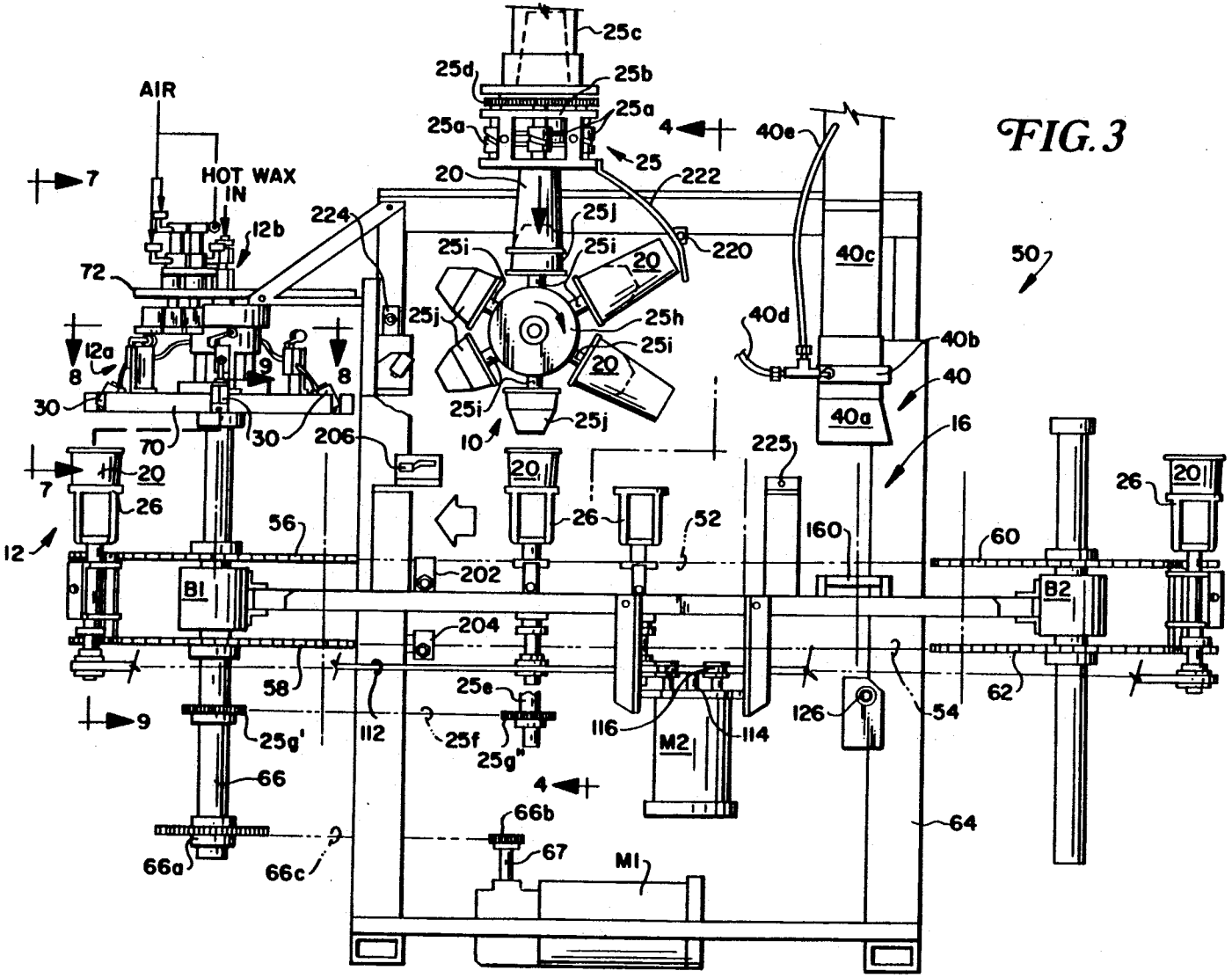
FIG. 3 is a side elevation view of the apparatus depicted in FIG. 2.

Accompanying FIGS. 2 and 3 show structures associated with one preferred embodiment of a container wax-coating apparatus 50 according to the present invention. As is seen, the apparatus 50 includes a number of aligned cup holders 26 rigidly connected to upper and lower endless drive chains 52, 54. The drive chains 52, 54 are, in turn, operatively coupled to and between driven sprockets 56, 58 and idler sprockets 60, 62 mounted to the frame assembly 64 via suitable bearings B1 and B2, respectively. The driven sprockets 56, 58 are coupled rigidly to main shaft 66 which is in turn coupled operatively to the drive shaft 67 of motor M1 via sprockets 66*a*, 66*b*, and drive chain 66*c*. As a result, the shaft 66, and hence the driven sprockets 52, 54, are rotated in a clockwise direction (as viewed in FIG. 2) so as to cause the cup holders 26 to be conveyed continually into operative position at the cup feeding station 10.

Figure 4:
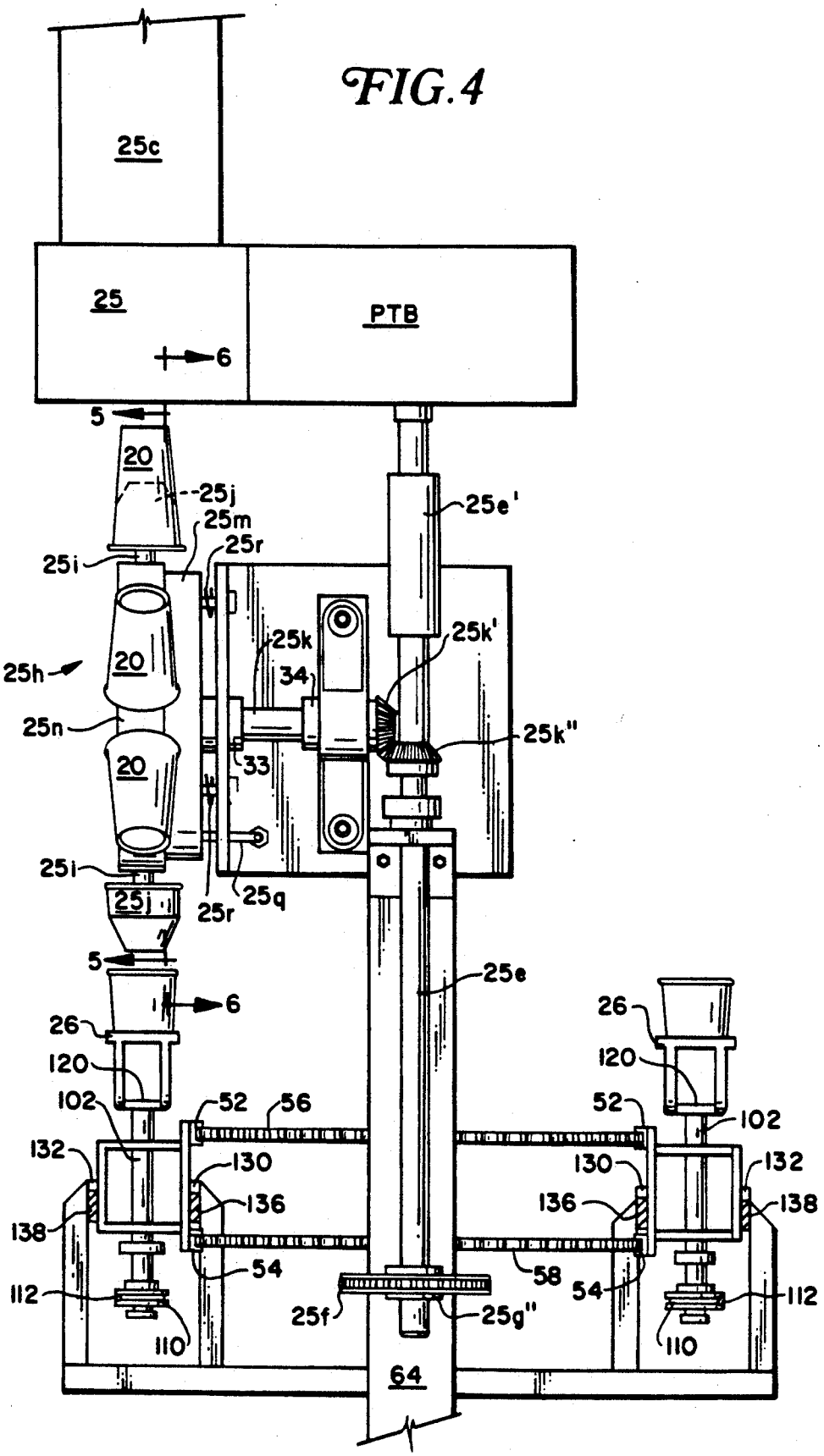
FIG. 4 is an elevational view taken along line 4—4 in FIG. 3.

The cup feeding mechanism 25 associated with the cup feeding station 10 is perhaps best shown in accompanying FIGS. 3 and 4 as comprised of a number of helically-grooved feed synchronizers 25*a* coupled to a cage frame 25*b*. The helical grooves of the synchronizers 25*a* engage the top curl of the last cup in an inverted stack of cups 20 within a feed tube 25*c*. The synchronizers 25*a* are rotated via a common chain drive 25*d* which is, in turn, driven by a power take-off shaft 25*e* coupled operatively to the driven shaft 66 via drive chain 25*f* and sprockets 25*g*', 25*g*''.

The cups 20 are thus discharged via the cup feeding mechanism 25 onto a synchronously rotated star-shaped cup-inversion assembly 25*h*. In this regard, the cup-eversion assembly 25*h* is rotated in a clockwise direction (as viewed in FIG. 3) by means of a power take-off shaft 25*k* operatively coupled to drive shaft 25*e* via intermeshed bevel gears 25k' and 25k" (see FIG. 4). It will also be observed that shaft 25k is supported to the frame 64 of apparatus 50 for rotational movements via bearings B3 and B4. The upper extent of shaft 25e (noted by reference numeral 25e') is operatively coupled to power transfer box PTB associated with cup-feeding mechanism 25.

The cup-inversion assembly 25h includes a number of radial shafts 25i that terminate in a cup feeding mandrel 25j. Empty ones of the mandrels 25j are thus presented sequentially to the cup feeding mechanism 25, whereby individual cups are discharged from the stack via the driven synchronizers 25a and onto a respective awaiting empty mandrel 25j. The cup 20 and mandrel 25j are then conveyed as a unit by the rotating cup-eversion assembly 25h until the cup 20 assumes an upright condition. An empty one of the cup holders 26 will at that time be positioned synchronously below the upright cup 20. The cup 20 will thus be discharged from its associated mandrel 25j and into the awaiting empty cup holder 26.

The cups 20 are discharged synchronously into awaiting empty cup holders 26 with assistance from pressurized air as will be discussed with reference to accompanying FIGS. 4–6. As is seen, the cup inversion assembly 25h includes a stationary support and air-distributor plate 25m and a rotary plate 25n, the latter including the radial shafts 25i and their associated mandrels 25j. The rotary plate 25n also includes a fluid passageway 25p defined between an inlet end 25p' (which opens onto the back surface 25n' of plate 25n), and an outlet end 25p" (which opens onto a central location at the lowermost end of each mandrel 25j). The stationary plate 25m, on the other hand, defines an arcuate slot 25m' which is in fluid communication with conduit 25q connected to a source of pressurized air (not shown). The stationary plate 25m is, moreover, urged into contact with the rotary plate 25n via compression spring assemblies 25r.

It will be appreciated that each of the inlets 25p' of passageways 25p will be brought sequentially into alignment with the slot 25m' defined in plate 25m as the rotary plate 25n rotates. Thus, temporary fluid communication will be established between the source of pressurized air (not shown) and the passageway 25p at essentially the same time as an empty cup holder 26 is brought into alignment with the associated mandrel 25j. This temporary fluid communication will cause a short burst of pressurized air to be discharged through the outlet 25p" against the bottom wall of the cup 20 on mandrel 25j thereby forcibly assisting in its removal and discharge into the awaiting empty cup holder 26.

The cups 20 and their associated cup holders 26 are then sequentially conveyed as units to the interior wax coating station 12. As is seen in accompanying FIG. 3, the wax coating station 12 generally includes a wax distribution subassembly 12a having a rotatable wax distribution plate 70, and a wax application control subassembly 12b having a stationary support plate 72. In general, the wax distribution subassembly 12a will be rotated concurrently with the driven sprockets 52, 54, so as to sequentially index one of the spray nozzles 30 equally circumferentially spaced-apart about the wax distribution plate 70 with a respective cup 20 during conveyance of the latter along the treatment path established by drive chains 52, 54.

Figure 7:
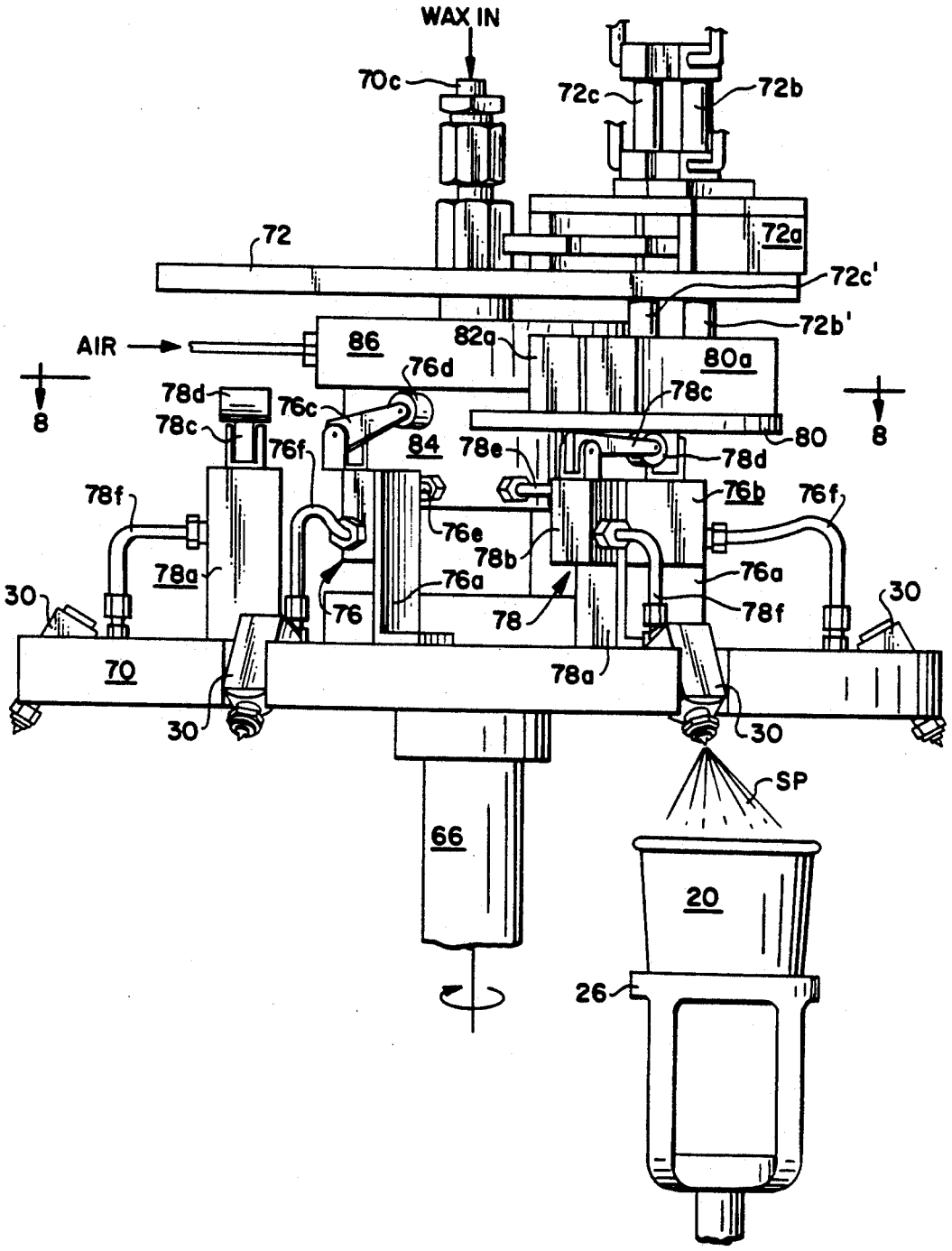
FIG. 7 is a front elevational view of the wax-coating station according to the present invention as taken along line 7—7 in FIG. 3, but shown in an enlarged manner for clarity of presentation.
Figure 8:
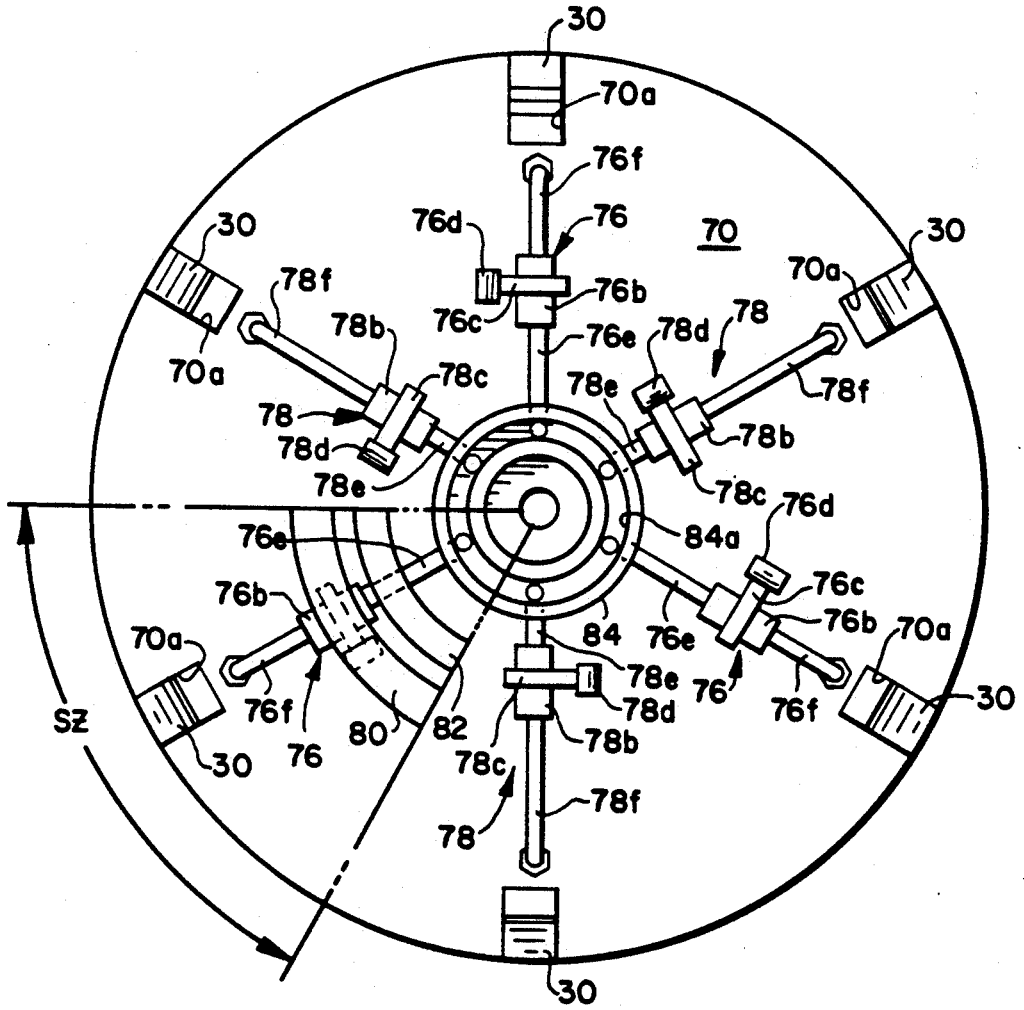
FIG. 8 is a plan view of the wax distribution subassembly according to the present invention as taken along line 8—8 in FIG. 3.
Figure 9:
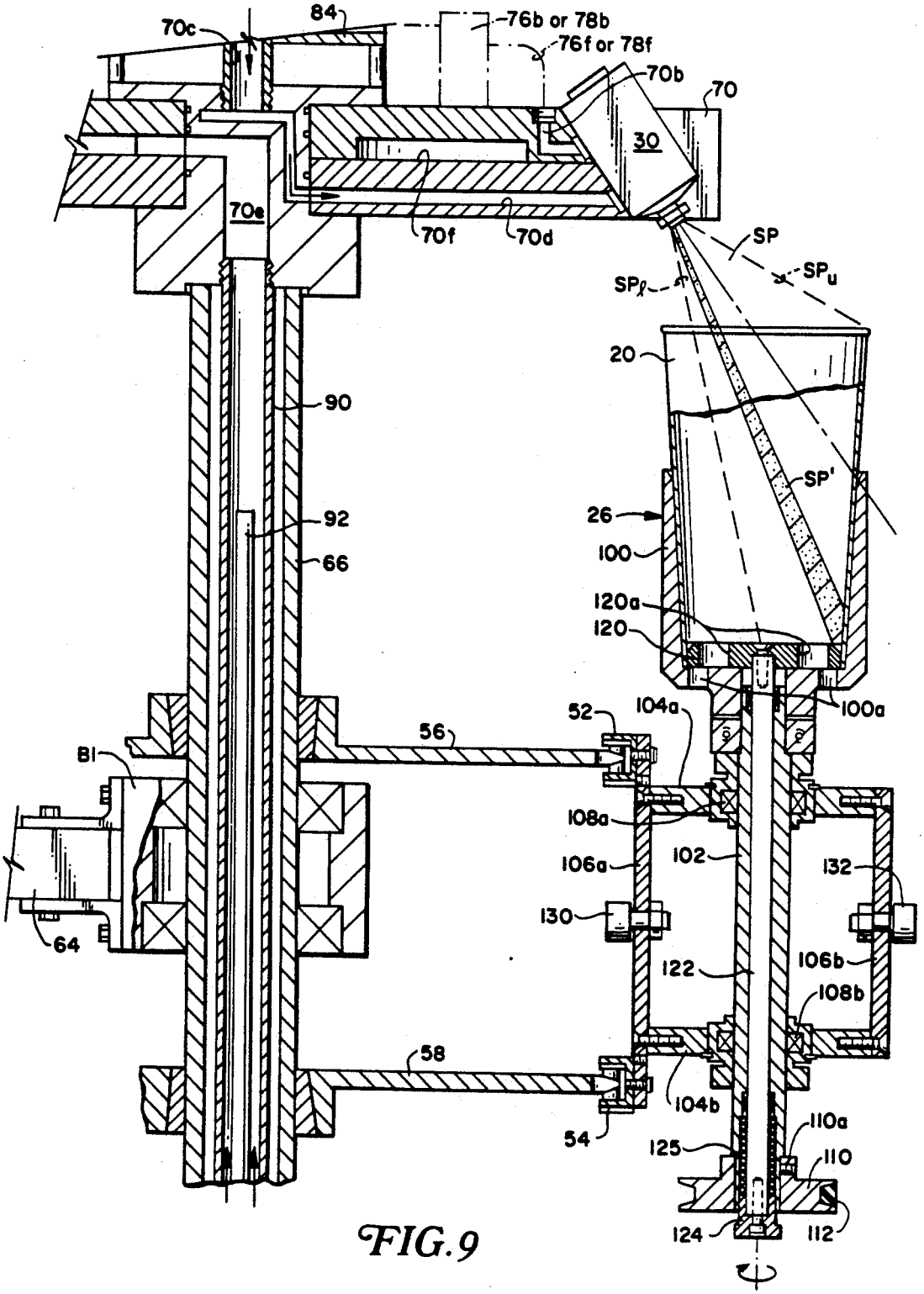
FIG. 9 is a cross-sectional elevational view of the wax-coating station as taken along line 9—9 in FIG. 3.

Accompanying FIGS. 7–9 show in greater detail the wax distribution and application control subassemblies 12a, 12b, respectively. As noted previously, the wax distribution subassembly is generally comprised of a wax distribution plate 70 which includes a number of radial recesses 70a spaced-apart at equal intervals about the circumference of the plate 70. The spray nozzles 30 are each operatively received within a respective one of the recesses 70a so as that the spray discharged therefrom will be directed generally downwardly and outwardly at a selected angle (e.g., approximately 30°) relative to the rotation axis of shaft 66.

A concentric array of pneumatic switching assemblies 76, 78, are operatively associated with respective ones of the nozzles 30 as shown more clearly in accompanying FIG. 8. In essence, the pneumatic switching assemblies 76 are positioned on the wax distribution plate 70 along an outer circle so as to be in alignment with outer cam plate 80. The pneumatic switching assemblies 78, on the other hand, are positioned on the wax distribution plate 70 along an inner circle so as to be in alignment with inner cam plate 82. Moreover, it will be observed that the switching assemblies 76 are circumferentially interposed between adjacent switching assemblies 78 (and vice-versa) so that the assemblies 76 and 78 are circumferentially staggered.

The switching assemblies 76, 78 are rigidly mounted to the upper surface of wax distribution plate 70 by means of mounting brackets 76a, 78a, which carry normally closed (NC) pneumatic switches 76b, 78b, respectively. The pneumatic switches 76b, 78b are activated (i.e., opened) by means of a pivotal actuator arm 76c, 78c, which includes a roller 76d, 78d, respectively, at the terminal ends thereof. The actuator arms 76c, 78c are each biased into a raised position by means of a spring (not shown), and are pivotable into a depressed position against the bias force of the spring in response to the rollers 76d, 78d being brought into contact with a respective one of the cam plates 80, 82. When the actuator arms 76c, 78c are in the depressed position, the switches 76b, 78b, are opened to establish fluid communication between the air inlet conduits 76e, 78e and the air outlet conduits 76f, 78f, respectively, and thereby allow pressurized air to flow on to the respective nozzle 30.

As is perhaps more clearly depicted in accompanying FIG. 8, the inlet conduits 76e, 78e are each in fluid communication with the annulus 84a of air distributor collar 84 which rotates concurrently with rotation of plate 70. Pressurized air is introduced into slip collar 86 (see FIG. 7) which remains stationary during rotation of plate 70 but communicates with the annulus 84a of distributor collar 84. As a result, pressurized air is supplied to each of the inlet conduits 76e, 78e during rotation of plate 70.

The outlet conduits 76f, 78f, are each in fluid communication with a channel 70b defined within plate 70 as shown in FIG. 9. The channel 70b, in turn, communicates with an air port associated with its respective nozzle 30. Thus, when pressurized air is introduced into the outlet conduits 76f, 78f, the channels 70b will transfer the same to an associated respective nozzle 30, causing it to operate and discharge the spray pattern SP of molten wax towards the cup 20 with which the nozzle 30 is indexed.

Molten wax is supplied to the wax distribution plate 70 through a wax inlet 70c by means of a gear pump (not shown). In this regard, the molten wax should be supplied to the inlet 70c at a pressure of between 650–700 psi for the preferred nozzles 30 employed to form the spray pattern SP. The wax inlet 70c, in turn, is in fluid communication with a wax supply channel 70d operatively associated with a wax inlet port of each nozzle 30. As a result, an available stand-by supply of molten wax is provided to the nozzles 30 so that upon nozzle actuation (i.e., via pressurized air entering the associated channel 70b as controlled by means of the pneumatic switches 76b or 78b, as the case may be), the spray pattern SP of molten wax is discharged therefrom.

The wax distribution plate 70 is heated to a temperature above the melt temperature of the wax so that the wax does not solidify therewithin. Preferably, the distribution plate 70 is heated by means of steam, but electrical resistance heaters could likewise serve equivalent functions. In this regard, accompanying FIG. 9 depicts a steam system associated with the wax distribution plate 70.

As is seen therein, a steam supply pipe 90 (concentrically disposed within shaft 66) introduces steam via inlet 70e into an annular chamber 70f defined within the wax distribution plate 70. Heat will thus be transferred to the plate 70 by virtue of the presence of steam within the annular chamber 70f so as to maintain the molten state of the available stand-by supply of wax within the plate 70. Condensate returns along the same path through which the steam is supplied. A condensate return pipe 92 is concentrically disposed within the steam supply pipe 90. As will be appreciated, the level of condensate within the annulus between pipes 90 and 92 will not exceed the top of the latter as it will then enter the pipe 92 and be withdrawn. Steam will meanwhile percolate through the collected condensate in the annulus between pipes 90 and 92.

In operation, the rollers 76d, 78d will sequentially be brought into bearing contact with a respective one of the cam plates 80, 82 during rotation of the wax distribution plate 70. As a result, the actuator arms 76c, 78c will be pivoted sequentially into their depressed position to open the respective pneumatic switches 76b, 78b, and thereby allow pressurized air to be passed to outlet conduits 76f, 78f. Pressurized air will thus enter the channel 70b and will cause the nozzle 30 to operate so as to discharge the spray pattern SP of molten wax towards cup 20. Continued rotation of the wax distribution plate 70 will break the contact between the rollers 76d, 78d and the respective cam plate 80, 82 so as to allow the actuator arms 76c, 78c to return to their "normal" raised position—thereby again closing the pneumatic switches 76b, 78b. As a result, the discharge of molten wax from the associated nozzle 30 is terminated.

The nozzles 30 are thus controllably operated so as to discharge a spray of molten wax throughout an arcuate spray zone SZ (see FIGS. 2 and 8). The angle of the arcuate spray zone SZ is, of course, dictated by the arcuate dimension of the cam plates 80, 82, since the spray nozzles only operate when the rollers 76d, 78d of pneumatic switches 76b, 78b are respectively brought into contact therewith during rotation of the wax distribution plate 70. Any overspray of molten wax may be captured by means of an overspray hood 88 (see FIG. 2). The captured wax may then be vacuum transferred via conduit 89 to a collection site where it may be recycled.

As mentioned briefly above, the wax application control subassembly 12b is provided with a support plate 72 that is rigidly coupled to the frame 64 of apparatus 50 at the interior waxing station 12. The support plate 72 includes a superstructure 72a which supports a pair of double acting air cylinders 72b, 72c. The double acting air cylinders 72b, 72c each include a movable shaft 72b', 72c' that is rigidly connected at its lower ends to mounting block 80a, 82a to which cam plates 80, 82 are connected (see FIG. 7). The shafts 72b', 72c' of the double acting cylinders 72b, 72c may thus be reciprocally moved between extended and retracted positions in dependance upon the side of the cylinders 72b, 72c that is pressurized.

Normally, the cylinders 72b, 72c are each in a state whereby the shafts 72b', 72c', respectively, are in their extended position as shown in FIG. 7. As such, the cam plates 80, 82 will be in a lowered position so that rollers 76d, 78d associated with the pneumatic switches 76b, 78b may be brought into contact therewith to operate their respective nozzles 30 as was described previously. However, the shafts 72b' and/or 72c' may be raised controllably by reversing the pressurized air to cylinders 72b and 72c so that the cam plates 80 and/or 82 may be raised out of contact with the rollers 76d and/or 78d, respectively. In such a manner, the spray nozzles 30 may be selectively inactivated to prevent wax from being sprayed therefrom (as may be needed in the event a cup 20 is not present within a cup holder 26).

Accompanying FIG. 9 also shows in greater detail the structures associated with the cup holder 26. In this regard, the cup holder 26 generally comprises a cup basket 100 sized and configured to hold a cup 20 therewithin in friction fit relationship, and an elongate tubular stem 102 which is rigidly coupled at its upper end to the lower portion of the cup basket 100. As will be appreciated, the cup basket 100 can be easily removed from the stem 102 and replaced with a different size cup basket so as to accommodate a different size cup.

A frame assembly comprised of upper and lower frame plates 104a, 104b, and inner and outer frame plates 106a, 106b, respectively, provide structural support for the cup holder 26 generally. The frame assembly includes upper and lower bearings 108a, 108b operatively associated with the upper and lower frame plates 104a, 104b, respectively, so as to allow the stem 102, and hence the cup basket 100 rigidly coupled at the stem's upper end, to rotate freely with respect to the frame assembly. The inner frame plate 106a is rigidly connected to the upper and lower chain drives 52, 54. As a result, the cup holder 26 is caused to be conveyed concurrently with the chain drives 52, 54 by virtue of the driven sprockets 56, 58.

A pulley 110 is rigidly connected to the lower end of stem 102 and accommodates a portion of an endless tensioned drive belt 112. The drive belt 112 is operatively driven by means of drive pulley 114 associated with motor M2, and is tensioned by means of idler pulleys 116 (see FIGS. 2 and 3). As a result, cup basket 100 is rotated about the axis of the stem 102 due to the driven engagement between the drive belt 112 and the pulley 110. This rotation of the cup basket 100, in turn, rotates the cup 20 held thereby relative to the spray pattern SP of molten wax discharged from the nozzles 30 so as to evenly coat the cup's interior surfaces.

The rotation direction of the cups 20 is preferably such that the edge of the longitudinal seam of the interior sidewall leads into the wax spray. In such a manner, adequate sealing along the longitudinal seam is ensured. For example, in the embodiment of the apparatus 50 shown in the accompanying FIGURES, the cup baskets 100 are rotated in a counterclockwise direction as viewed in FIG. 2.

The bottom of the cup 20 is positioned closely adjacent to (preferably rests upon) a plunger 120 located within the cup basket 100. The plunger 120 is, in turn rigidly coupled to an upper end of an actuator rod 122 that is reciprocally movable within the tubular stem 102. A bearing cap 124 is rigidly connected to the lower end of stem 124 and is adapted to contact a cam wheel 126 associated with the cup discharge station 16.

A compression spring 125 exerts a bias force against the bearing cap 124 so as to urge the plunger 120 to be seated against the bottom of the cup basket 100 as shown in the state shown in FIG. 9. The plunger 120 may, however, be upwardly displaced from the bottom of the cup basket 100 (i.e., in response to upward displacement of the actuator rod 122) so as to, in turn, urge the cup 20 upwardly relative to the cup basket 100. Vent apertures **120*a* defined in the plunger 120 are provided so as to allow ambient air to contact the cup bottom for purposes of cooling. In the event that the cup baskets 100 are not formed with extensive side openings as shown in the accompanying drawings, vent apertures 100*a* may be provided for the purposes of cooling as shown in FIG. 9**.

It will be appreciated that, since the endless flexible drive chains 52, 54 are each unsupported in the regions between the driven sprockets 56, 58 and the idler sprockets 60, 62 the weight of the cup holders 26 connected thereto would cause the drive chains to sag in the unsupported regions. Thus, the cup holders are preferably provided with inner and outer support rollers 130, 132, which rest upon (and are supported by) a pair of linear inner and outer rigid tracks 136, 138 (see FIG. 4) extending between the driven sprockets 56, 58 on the one hand, and the idler sprockets 60, 62 on the other hand.

Once the interior of the cups 20 has been coated with wax at the wax coating station 12, the cup holders 26 may be sequentially presented to the top curl waxing station 14 (see FIG. 2), where a localized stream of wax can be applied to the top curl of each cup 20 via top curl spray nozzle 34. The top curl spray nozzle 34 is preferably stationary, but since the cups 20 will be rotated relative to the wax stream discharged thereby (i.e., due to rotation of the cup baskets 100 via drive belt 112 discussed above), the entire circumferential extent of the top curl will be coated with localized heavily applied wax. The top curl will therefore be stiffened by this relatively heavily and locally applied wax. Any overspray from the nozzle 34 may be collected by conduit 94 and transferred via vacuum to a collection site where it may be recycled in a manner similar to that described above with respect to overspray hood 88 associated with interior waxing station 12.

Figure 10B:
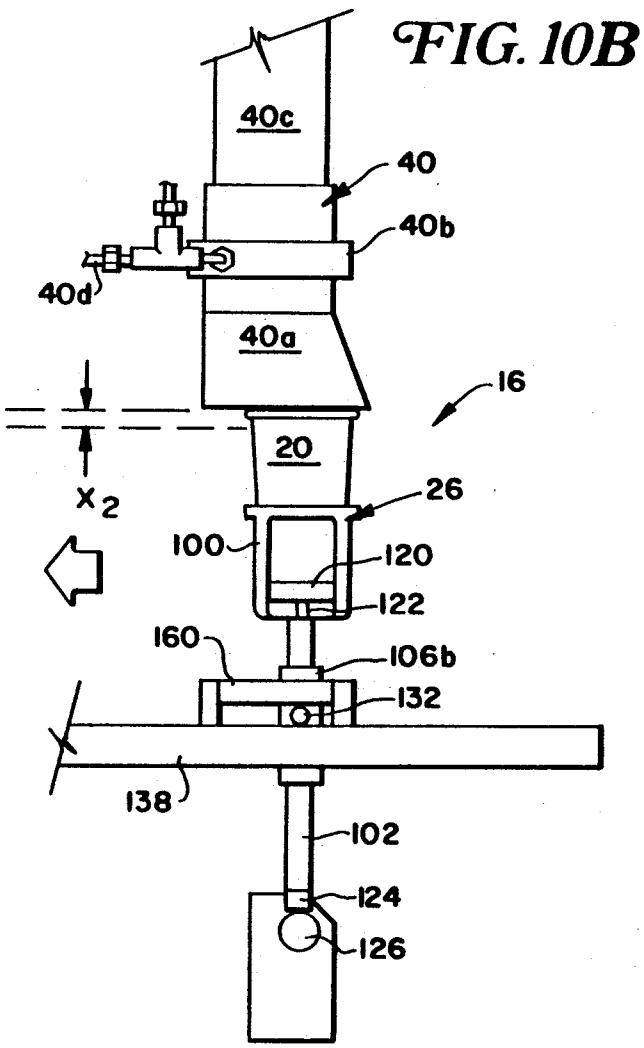
FIG. 10B is a schematic elevation view similar to FIG. 10A, but shown in a state whereby the cup and its associated cup holder are at the cup removal station.
Figure 10A:
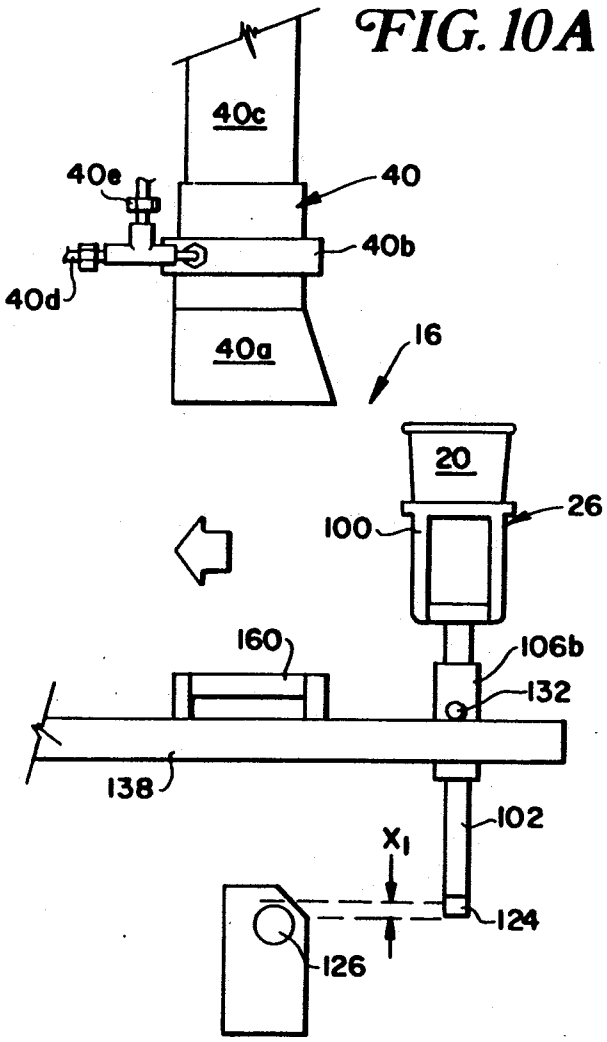
FIG. 10A is a schematic elevation view of the preferred cup removal station employed in the apparatus of the present invention, and depicted in a state whereby a cup and its associated cup holder are approaching the cup removal station.

The removal of a cup 20 from its associated cup holder 26 at cup discharge station 16 is schematically depicted in accompanying FIGS. 10A and 10B. The principal component of the cup discharge station 16 is a pneumatic tube system 40 generally comprised, in ascending order, of an elliptical inlet hood **40*a*, a Venturi ring 40*b*, and a discharge tube 40*c*. Pressurized air is supplied to the Venturi ring 40*b* via air supply conduit 40*d* so as to create a region of low pressure within the inlet hood 40*a* urging cups 20 to be drawn thereinto. The pressurized air then acts upon the cups 20 in the tube 40*c* so as to transfer them to a collection site, for example. A branch conduit 40*e* may direct a portion of the pressurized air to an upstream location within tube 40*c* so as to assist in pneumatically transferring the cups 20** therewithin.

As shown particularly in FIG. 10A, cup holders 26 will sequentially approach the cup discharge station 16. In this regard, the bearing cap 124 associated with each cup holder will be in its "normal" state—that is, will be at its lowermost position which is a dimension $x_1$ below the uppermost extent of cam wheel 126 in the vicinity of the discharge station 16.

Continued advancement of the cup holder 26 towards the cup discharge station 16 will thereby cause the bearing cap 124 to engage the cam wheel and be upwardly displaced thereby, as shown in FIG. 10B. Upward displacement of the bearing cap will responsively upwardly displace the plunger within the cup basket 100 as was described previously. This upward displacement of the plunger 120 will thereby responsively cause the cup 20 to be upwardly displaced towards inlet hood **40*a*** by a dimension $x_2$ which is equal to dimension $x_1$.

Upward displacement of the cup 20 by means of the interengagement of the bearing cap 124 and cam wheel 126 serves to release the friction fit relationship between the cup 20 and the cup basket 100, in addition to bringing the cup into a more physical proximity to the inlet hood **40*a* close physical proximity to the inlet hood 40*a* whereby the cup 20 may be more easily drawn into the pneumatic removal system 40 by virtue of the low pressure region within the hood 40*a***.

Since the cup holders 26 are rigidly connected to the flexible endless drive chains 52, 54, and since the cup discharge station 16 is located physically between the drive sprockets 56, 58 and the idler sprockets 60, 62, the entire cup holder 26 and drive chains 52, 54 could be upwardly displaced upon interengagement between the bearing cap 124 and the cam wheel 124, thereby possibly defeating the cup removal functions described above. To prevent this, means are provided in the form of a retaining track 160 which is rigidly spaced above support track 138 so as to define therebetween a space to closely accommodate the support rollers 132 of cup holders 26. In this regard, the retaining track 160 is of sufficient axial length so that the support roller 132 is accepted in the space between the tracks 160/138 prior to interengagement of the bearing cap 124 and cam wheel 126. In this manner, the retaining track 160 vertically captures the support roller 132 and thereby prevents significant vertical displacement of the cup holder 26 when the bearing cap 124 engages the cam wheel 126. At the same time, however, the cup holder 26 is still allowed to be conveyed horizontally via the drive chains 52, 54.

Figure 11:
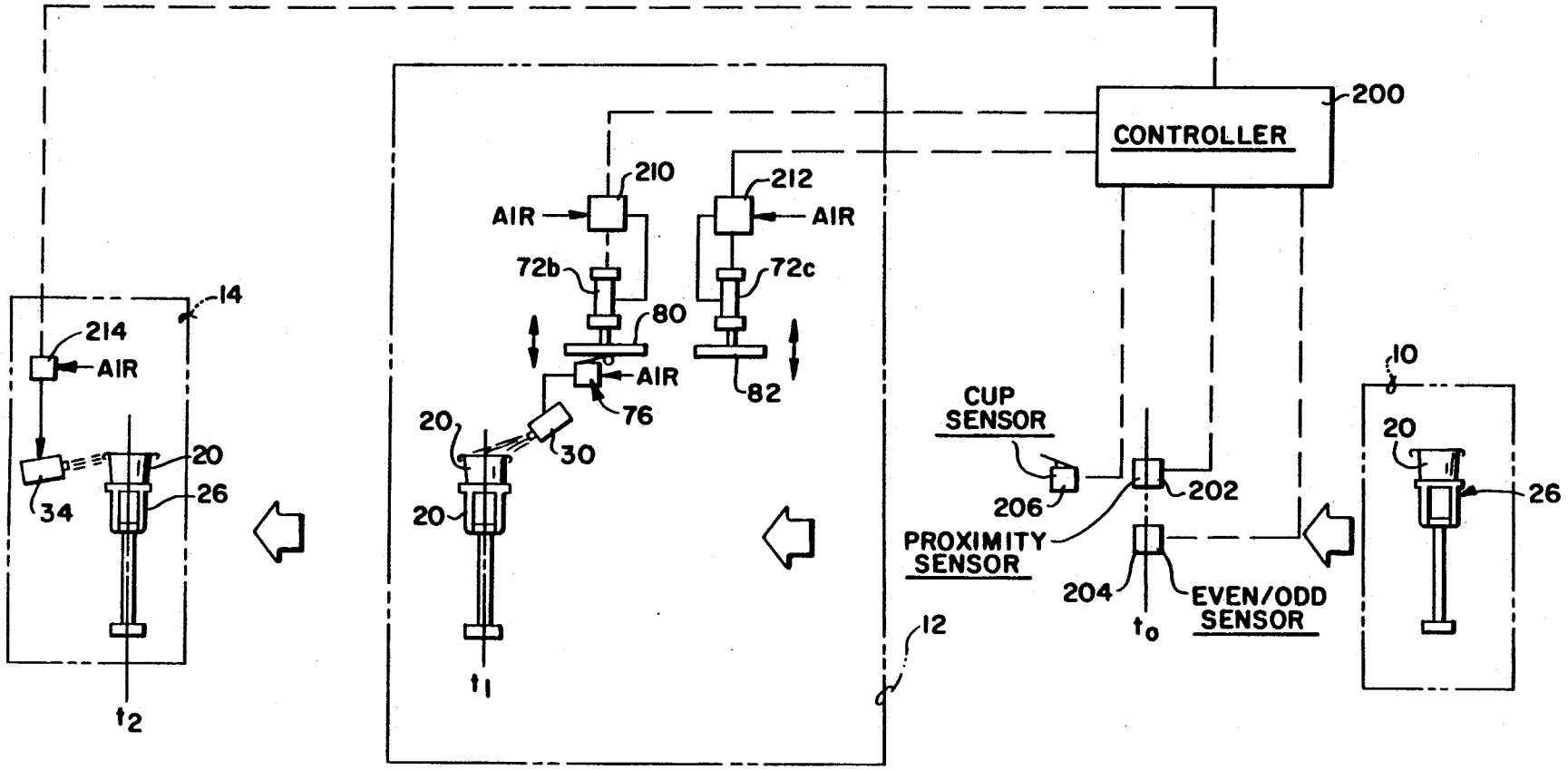
FIG. 11 is a schematic representation of the control system employed in accordance with the present invention.

Accompanying FIG. 11 shows in schematic fashion a preferred control scheme according to the present invention. In this regard, the control scheme generally includes a microprocessor controller 200 which receives input signals from a pair of even/odd sensors 202/204 and a cup sensor 206. One possible physical location for each of the sensors 202, 204 and 206 can be seen in accompanying FIG. 3.

A cup 20/cup holder 26 will be conveyed from the cup feeding station 10 and into operative association with even/odd sensors 202/204 at a position $p_o$. At that time, the even/odd sensors 202/204 will confirm the physical presence of a cup holder 26 and will issue a signal to controller 200. Simultaneously, the even/odd sensors 202/204 will determine whether the particular cup holder 26 is an "even" or an "odd" numbered cup holder—for example, by sensing a coded marking or the like physically on the cup holder. The respective even-/odd sensors 202/204 will therefore issue a pulse signal each time a determination is made that particular cup holders are "even" or "odd" numbered cup holders.

The pulse signals from the even/odd sensors 202, 204, will be assigned to a respective shift register internally within controller 200. The respective "even" and "odd" shift registers within controller 200 will thus be supplied with a pulse signal from one of the even/odd sensors 202/204 (i.e., in dependance upon whether the cup holder 26 that is sensed is itself "even" or "odd"). Each time a pulse signal is received, the internal shift register will advance each registered signal one step corresponding to an advance of the cup holder to the next position along its path of conveyance. The shift registers within the controller 200 will thereby "track" the cup holders as they are conveyed to each of the wax coating and top curl waxing stations, 12 and 14, respectively. The controller 200 will thus "know" that a particular cup 20/cup holder 26 will be located physically at positions $p_1$ and $p_2$ within the interior wax coating station 12 and top curl waxing station 14, respectively.

The cup sensor 206 confirms that a cup 20 is physically present in the cup holder 26 and issues a signal indicative of such cup presence. In the event that the even/odd sensors 202/204 and the cup sensor 206 respectively issue signals indicative of the physical presence of a cup holder 26, and that a cup 20 is within that cup holder 26, the system is deemed to be in a "normal" state of operation. As a result, the nozzles 30 are allowed to coat the interior of the cup 20 with wax at waxing station 12, and the nozzle 34 is allowed to apply a localized stream of wax along the cup's top curl.

The absence of a cup 20 within a holder 26 can be tolerated by the control system of the present invention since the absence of a cup 20 is not necessarily indicative of serious machine failure. For example, the helical grooves of the synchronizers 25*a* may have failed to "grip" a top curl of a cup 20, and as a result the cup feeder 25 may have simply failed to dispense one cup onto the cup inversion mechanism 25*h*. The absence of a cup 20 in a cup holder, however, requires disabling not only that nozzle 30 with which the empty cup holder 26 will be indexed at interior wax-coating station 12, but also the nozzle 34 at top curl waxing station 14. The control system according to the present invention thus accomplishes such functions.

Upon receipt of a signal from the cup sensor 206 indicative of the absence of a cup 20 within holder 26, the controller 200 will issue a command signal to the appropriate one of the solenoid valves 210, 212 associated operatively with air cylinders 72*b*, 72*c* in dependance upon whether the sensed holder 26 is determined by the even/odd sensors 202/204 to be an "even" numbered or "odd" numbered cup holder, respectively. In the example illustrated in accompanying FIG. 11, the cup holder 26 just happens to be an "odd" numbered cup holder, and thus its nozzle 30 is controlled by means of a respective pneumatic switching assembly 76 (i.e., arranged along an outer circle as compared to switching assemblies 78). As a result, the controller 200 will issue a command signal to solenoid 210.

Operation of solenoid 210 serves to reverse the pressurized air to cylinder 72*b* which, in turn, raises cam plate 80. Since the internal "odd" shift register of controller 200 will have been continually "tracking" the cup holder 26 from position $p_o$, the controller 200 will issue the command signal to solenoid 210 when the cup holder 26 reaches position $p_1$—i.e., at or just prior to indexing of the the empty cup holder 26 with its respective nozzle 30. Since the cam plate 80 will be raised upon receipt of the command signal by solenoid 210, the pneumatic switching assembly 76 will not be activated, thereby disabling its associated nozzle 30. As a result, wax is not sprayed into the empty cup holder 26.

The internal "odd" shift register of controller 200 continues to "track" the empty cup holder 26 to the top curl waxing station 14. Thus, in a manner similar to that described above, the controller 200 will "know" when the empty cup holder has reached a position $p_2$ at or just prior to the top curl waxing station 14. The controller 200 will issue a command signal when cup holder 26 is in position $p_2$ to solenoid valve 214 thereby disabling its associated nozzle 34.

Further controls may be provided as deemed necessary. For example, in the embodiment shown in FIG. 3, a cup feeding sensor 220 is operatively positioned with respect to a radially displaceable fender 222. The sensor 220 and fender 222 are positioned with respect to one another so that the fender 222 will be outwardly displaced to contact and operate the sensor 220 in the event that multiple cups are present on a single mandrel 25*j*. That is, the fender 222 will contact and operate sensor 220 due to the abnormal radial dimension attributable to more than one cup on a single mandrel 25*j*. In the event of multiple cups being present on a single mandrel 25*j*, the sensor 220 will thus issue a signal to controller 200 which will, in turn, shut down the entire apparatus.

A similar apparatus "shut down" will occur in the event that a cup 20 fails to be discharged from its associated mandrel 25*j* and into an awaiting empty holder 26 at cup feeding station 10, or in the event that a cup fails to be removed from a cup holder at cup removal station 16. In this regard, a sensor 224 is positioned in the arcuate path of a cup 20 remaining on a mandrel 25*j* just upstream of the cup feeding mechanism 25. The sensor 224 will thus be contacted by a cup 20 which remains on its mandrel 25*j* and will issue a signal to controller 200. Likewise, a sensor 225 is positioned downstream of cup removal station 16 at a height whereby contact may be made with any cup 20 that remains in its associated cup holder 26 (i.e, is not removed via the pneumatic removal system 40).

The spray pattern SP employed by the nozzles 30 is shown in schematic fashion in accompanying FIG. 9. It will be understood that the spray pattern SP is relatively narrow (as measured in a direction transverse to the plane of FIG. 9) and oriented generally parallel to the longitudinal axis of the cups 20 (i.e., generally parallel to the plane of FIG. 9). Moreover, the spray pattern SP will exhibit an upper extent $SP_u$ that is generally tangential to the upper lip of the cup, and a lower extent $SP_1$ that is generally coincident to the centralmost portion of the cup's bottom wall.

The spray pattern SP is also such that a greater volume of wax per unit time is directed towards the seam formed between the cup's bottom and side walls. That is, the spray pattern SP will have a region SP' of increased wax volume generally directed towards the bottom and side wall seam.

Nozzles 30 exhibiting a spray pattern as described above are commercially available from Nordson Corporation, Amherst, Ohio. More particularly, the preferred nozzle 30 will employ a Nordson Standard H20 Module and a controlled pattern distribution nozzle insert (such as a nozzle insert identified by Nordson Part Nos. 092200 or 092062) which discharges a volumetrically asymmetrical spray pattern SP as described above.

Virtually any wax conventionally employed to coat paperboard containers may likewise be employed according to the present invention, such as natural or synthetic paraffin. Preferred is common petroleum paraffin wax having a melting point of approximately 130°-140° F.

As indicated previously, it is important to the present invention to prevent the applied wax from saturating the paperboard stock from which the cups 20 are fabricated. In this regard, it is important for the wax to solidify rapidly upon contact with the cup's interior surface. Thus, it is especially preferred that the melting point of the paraffin wax be increased by incorporating an additive for such purpose in the wax formulation. In this manner, the applied wax will more rapidly solidify under ambient process conditions.

Preferably, the wax additive will be an aromatics-free, high melting point, low viscosity (e.g., about 10.0 cp @250° F. - ASTM D 2669) synthetic wax with a congealing point (ASTM D 938) of about 208° F. The preferred additive is Paraflint TM H1 synthetic wax commercially available from Moore & Munger Marketing, Inc., Shelton, Conn. The wax additive is employed in minor (e.g., approximately 5 wt. %), but effective, amounts sufficient to impart a melting point temperature to the resulting paraffin wax formulation of approximately 144° F.

As mentioned briefly above, the melting point of the paraffin wax formulation is important since it allows more rapid solidification of the applied wax onto the cup's interior surface (and hence minimizes the possibility of wax saturation throughout the paperboard stock). It is also important, however, that the atomized wax remain molten throughout its flight towards the container inner surface. Otherwise, the wax could at least partially solidify during its flight and thereby form a coarse, inhomogeneous layer on the interior cup surfaces. The atomized wax particles are thereby maintained in their molten state throughout their flight towards the interior container surface, and are thus capable of spreading and coalescing upon contact with the interior container surface to form a homogenous wax layer thereupon.

The temperature of the molten wax is advantageously controlled—e.g., via heating the wax distribution plate 70 as described above—so that the atomized wax particles remain molten throughout their flight towards the interior cup surfaces. In practice, it is preferred that the plate 70 be maintained at or above a temperature of about 240° F. (as measured at the periphery of the plate 70 near a nozzle 30) when a paraffin wax formulation as described above having a melting point of approximately 144° F. is used.

Since the cups 20 are rotated a number of times (e.g., about four times) relative to the wax spray pattern SP discharged from nozzle 30 during their traversal within the spray zone SZ, a corresponding number of wax layers will be applied to the interior cup surfaces. That is, the first layer of wax during a first rotation of the cup 20 will be applied directly onto the single ply paperboard stock and subsequent wax layers will be applied onto previously applied (and substantially solidified) wax layers, to effect a beneficial wax "build up" on the interior cup surfaces. That is, the first layer of wax will be applied in an amount insufficient to saturate the single ply paperboard of the cup. By the time the cup begins its next revolution relative to the wax spray pattern SP, the initially applied wax layer will have at least substantially solidified to an extent whereby it essentially prevents subsequently applied wax from saturating the single ply paperboard stock and deleteriously affecting its normal opacity. In essence, therefore, the initial layer of wax, which by itself is insufficient to form a fluid impervious layer, is nonetheless sufficient to form a barrier on the interior surfaces of the paperboard cup to prevent wax saturation.

The beneficial "build-up" of wax on the interior surfaces of the cup and the manner in which the opacity of the paperboard is maintained is shown in the accompanying photographs of FIGS. 12 and 13. In this regard, FIG. 12 shows a sidewall cross-section of a conventional heavily wax-coated single ply paperboard cup whereby the wax (dyed red for visual clarity) saturates the entire thickness T* of the single ply paperboard stock PS* forming the cup's sidewall. In distinct contrast, FIG. 13 shows a sidewall cross-section of an interiorly wax-coated single ply paperboard cup according to the present invention. The wax coating WC (which has also been dyed red for visual clarity) is clearly visible on the interior surface of the single ply paperboard stock PS forming the cup's sidewall. Moreover, it will be observed that the wax does not saturate the thickness of the paperboard stock PS. The paperboard stock PS thus retains its normal opaque appearance.

Accompanying FIG. 14 schematically depicts another embodiment according to the present invention which generally includes a pretreatment assembly PTA in operative association with an interior wax-coating apparatus WCA. The wax-coating apparatus WCA is substantially similar to the apparatus 50 described above in terms of its wax-coating functions, but operates in a reverse direction thereto. Thus, structures included in the embodiment of FIG. 14 which find essentially identical structural and functional counterparts in the embodiment of the invention described previously will be identified by the same reference numeral, but will have an "I" prefix.

The pretreatment assembly PTA generally includes an endless flexible conveyor 300 operatively coupled to and between drive sprocket 302 and idler sprocket 304. The sprockets 302, 304 are arranged within a vertical plane so that the path circumscribed by the conveyor 300 is likewise within a vertical plane. Cups 20 may thus be deposited onto mandrels M (see FIG. 1) fixed to conveyor 300 at spaced locations therealong using a cup feeding mechanism I-25. The cups 20 will then be conveyed past the electrostatic spray coating guns 22, 24 where a lacquer, for example, can be electrostatically applied to the cup's exterior surface. The lacquer may be dried by means of a downstream heated drier 306.

The cup 20 may then be subjected to bottom wax-coating by means of nozzle 29, and top curl wax-coating by means of wax applicator 31 as described previously in connection with FIG. 1. The sprocket 302 will serve to invert the pretreated cups 20 and deposit them sequentially into respective awaiting cup holders I-26 associated with the wax coating assembly WCA. Thereafter, the cups 20 are subjected to interior wax coating using a wax distribution plate I-70 (and its associated controls). The completed cups may then be removed from the wax coating assembly WCA via pneumatic discharge mechanism I-40, and pneumatically conveyed within tube I-40c to a storage site.

As will now be appreciated, the present invention provides for novel methods and apparatus for interiorly wax coating paperboard containers. The equally novel interiorly wax coated containers thus exhibit aesthetically pleasing appearances, while yet retaining the beneficial attributes associated with wax- and polymer-coated containers generally.

Thus, while the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of applying a wax coating material to a surface of a single-ply paperboard container so as to render said paperboard container impervious to liquid foodstuffs, said method comprising the steps of:

forming a spray band of molten atomized wax coating material having a spray pattern which includes a continuous, but non-uniform, spray distribution having respective regions of greater and lesser volumes of said atomized wax coating material per unit time;

orienting said spray band so as to be generally parallel to a longitudinal axis of said single-ply paperboard container such that said spray band is directed towards the container surface and such that said said non-uniform spray distribution is positioned so that said region of greater volume of atomized wax coating material per unit time is directed towards one portion of the container and said lesser volume of atomized wax coating material per unit time is directed towards another portion of said container adjacent said one portion;

effecting relative rotation between said spray band and the container surface; and allowing a liquid-impervious effective, but paperboard nonsaturating, amount of said wax coating material to be applied onto the container surface.

2. A method of wax-coating interior surfaces of a paperboard container having a paperboard bottom wall and a generally tubular single ply paperboard side wall joined to said bottom wall along a circumferential bottom seam so as to render said paperboard container impervious to liquid foodstuffs, said method comprising the steps of:

(i) directing a spray band of atomized molten wax towards the container interior surfaces to be coated thereby such that said spray band is longitudinally oriented relative to said container; and (ii) applying successive coatings of said atomized wax upon said container interior surfaces, wherein said step of applying successive coatings includes, (a) applying at least one initial coating of wax upon said container interior surfaces in an amount insufficient to impart liquid-foodstuff impervious characteristics to said single ply paperboard container, yet sufficient to create a barrier to saturation of the single ply paperboard by subsequently applied wax coatings, and then subsequently (b) applying at least one wax coating over said at least one initial coating in an amount to impart liquid-foodstuff impervious characteristics to said paperboard container.

3. A method as in claim 2, wherein said (ii) includes effecting relative rotation between said container and said spray band so that the atomized wax is applied to the container interior surfaces in a successive plurality of coats.

4. A method as in claim 2, wherein priori to step (i) there is practiced the step of controlling the temperature of the wax so that the wax will remain molten when atomized and directed towards the container interior surfaces, but will solidify upon the container interior surfaces without saturating the side wall.

5. A method of wax-coating a generally cylindrical interior surface of a container formed of single-ply paperboard stock so as to render said single-ply paperboard stock impervious to liquid foodstuffs, said method comprising:

(i) directing a spray of molten wax towards said generally cylindrical interior surface of said paperboard container; and (ii) effecting a plurality of relative rotations between said container and said directed spray of molten wax so as to apply a corresponding successive plurality of wax layers upon said generally cylindrical interior surface of said container and thereby render said single-ply paperboard stock impervious to liquid foodstuffs, and wherein said step (ii) includes forming a barrier against wax saturation said single-ply paperboard stock with at least an initial one of said plurality of wax layers to prevent wax saturation by subsequently applied ones of said wax layers.

6. A method as in claim 5, including controlling the temperature of the molten wax so that it remains molten while in said spray, but substantially solidifies after contact with said interior surface of said container during a first rotation relative to said directed spray of molten was, and so that during subsequent rotations relative to said directed spray of molten wax, said molten wax substantially solidifies upon a previously applied and solidified wax layer, whereby said corresponding successive number of wax layers is formed.

7. A method of wax-coating interior surfaces of paperboard containers of the type having a paperboard bottom wall, and a generally tubular single-ply paperboard side wall joined to said bottom wall and defining an open end opposite said bottom wall, said method comprising the steps of:

(i) conveying a paperboard container to a wax-coating station along a treatment path and bringing said open container end into alignment with a wax spray nozzle at a location within said wax-coating station;

(ii) effecting relative movement between said wax spray nozzle and the open container end at said location within said wax-coating station; and (iii) controllably operating said wax spray nozzle in response to achieving said alignment between said open container end and said wax spray nozzle, whereby said interior container surfaces are wax-coated, and wherein said step of controllably operating said wax spray nozzle including:

(a) controlling the temperature of molten wax discharged by said wax spray nozzle so that the wax remains molten in a spray between said nozzle and said single-ply paperboard side wall, but substantially solidifies after contact with said single-ply paperboard side wall; and (b) effecting relative rotation between said wax spray nozzle and said single-ply paperboard side wall so as to apply a successive number of wax layers on said single-ply paperboard side wall such that initial ones of said successive number of wax layers form a barrier to prevent saturation of said single-ply paperboard side wall by subsequently applied ones of said successive number of wax layers.

8. A method as in claim 7, wherein step (i) is practiced by conveying said container along an arcuate treatment path, and wherein step (ii) is practiced by effecting said relative movement at said location along said arcuate treatment path.

9. A method as in claim 8, wherein step (ii) is practiced so as to maintain said alignment between said wax spray nozzle and said open end of said container as said container traverses at least a sector of said arcuate path within said wax-coating station, and wherein step (ii) is practiced by continuously operating said spray nozzle during said traversal of said sector by said container.

10. A method as in claims 1, 2, 5 or 7, which further comprises applying a moisture barrier coating on exterior surfaces of said container.

11. A method as in claim 10, wherein said step of applying a moisture barrier coating includes electrostatically spray-coating said exterior surfaces with a lacquer material.

12. A method of rendering single-ply paperboard containers impervious to liquid foodstuffs comprising the steps of:

forming a spray band of molten atomized wax-coating material having a spray pattern which includes respective regions of greater and lesser volumes of atomized coating material per unit time;

orienting said spray band so as to be generally parallel to a longitudinal axis of said single-ply paperboard container to thereby direct said spray band towards an interior surface of said single-ply paperboard container such that said region of greater volume of atomized wax-coating material per unit time of said spray pattern is asymmetrically biased towards a bottom wall of said container;

effecting relative rotation between said spray band and said interior surface of said container; and allowing a liquid-foodstuff impervious effective, but paperboard nonsaturating, amount of said wax-coating material to be applied onto said interior surface, whereby said paperboard container is rendered impervious to liquid foodstuffs.

13. A method of coating single-ply paperboard containers so as to render the same impervious to liquid foodstuffs, comprising the steps of:

(i) applying an initial layer of a molten wax coating material onto an interior surface of a paperboard container in an amount that is insufficient to both (1) saturate the single-ply paperboard forming the container and (2) render said single-ply paperboard impervious to liquid foodstuffs;

(ii) allowing the applied initial layer to solidify to form a barrier to paperboard saturation by subsequently applied coating layers of said wax coating material; and then (iii) applying at least one additional layer of said wax coating material over said initial layer in an amount sufficient to form a coating with said initial layer on said container interior surface which renders said single-ply paperboard container impervious to liquid foodstuffs.

14. A method of imparting liquid-impervious characteristics to a container having a side wall formed of normally opaque paperboard stock which becomes translucent when saturated with wax comprising applying a coating of wax to an interior surface of said side wall in an amount sufficient to impart liquid-impervious characteristics to said paperboard stock, yet insufficient to saturate the thickness of said paperboard stock, whereby said normally opaque appearance thereof is maintained.

15. A method as in claim 14, which further comprises forming said wax coating by applying a successive number of layers, at least initially applied ones of said number of layers being insufficient to impart liquid-foodstuff impervious characteristics to said single-ply paperboard stock but sufficient to prevent subsequently applied layers form saturating the single-ply paperboard stock.

16. A method as in claims 14 or 15, which further comprises directing a longitudinally oriented spray band of molten atomized wax towards the container interior surface, said spray band having respective regions of greater and lesser volumes of atomized wax per unit time, and positioning said spray band such that said region of greater volume of atomized wax per unit time is biased toward a bottom portion of the container.

* * * * *